US009840317B2

(12) United States Patent
Achiwa et al.

(10) Patent No.: US 9,840,317 B2
(45) Date of Patent: Dec. 12, 2017

(54) COOLING WATER PASSAGE STRUCTURE OF OUTBOARD MOTOR

(71) Applicant: SUZUKI MOTOR CORPORATION, Hamamatsu-Shi, Shizuoka-Ken (JP)

(72) Inventors: Tetsushi Achiwa, Hamamatsu (JP); Keisuke Daikoku, Hamamatsu (JP)

(73) Assignee: SUZUKI MOTOR CORPORATION (JP)

( * ) Notice: Subject to any disclaimer, the term of this patent is extended or adjusted under 35 U.S.C. 154(b) by 62 days.

(21) Appl. No.: 15/010,254

(22) Filed: Jan. 29, 2016

(65) Prior Publication Data

US 2016/0236763 A1 Aug. 18, 2016

(30) Foreign Application Priority Data

Feb. 13, 2015 (JP) ..... 2015-026188

(51) Int. Cl.
*F01P 3/20* (2006.01)
*B63H 20/28* (2006.01)

(52) U.S. Cl.
CPC ..... *B63H 20/285* (2013.01); *F01P 3/202* (2013.01)

(58) Field of Classification Search
CPC ..... F01P 3/202
See application file for complete search history.

(56) References Cited

U.S. PATENT DOCUMENTS 3,520,270 A * 7/1970 Miller ..... F01N 13/12 123/65 E
8,479,691 B1 * 7/2013 Taylor ..... F01P 3/202 123/41.29

FOREIGN PATENT DOCUMENTS

JP 2013-124592 A 6/2013

* cited by examiner

*Primary Examiner* — Edwin Swinehart
(74) *Attorney, Agent, or Firm* — Barnes & Thornburg LLP

(57) ABSTRACT

An outboard motor includes a cooling water passage structure, in which a combustion chamber periphery water jacket through which the cooling water flows around the combustion chamber and an exhaust port periphery water jacket through which the cooling water flows around the exhaust port are formed in the cylinder head, a cylinder periphery water jacket through which the cooling water flows around the cylinder is formed in the cylinder block, and an exhaust passage periphery water jacket through which the cooling water flows around the exhaust passage is formed around the exhaust passage. The water jackets are connected such that the cooling water from the water passage will flow through the combustion chamber periphery water jacket, the exhaust port periphery water jacket, the cylinder periphery water jacket, and the exhaust passage periphery water jacket in order.

10 Claims, 9 Drawing Sheets

COOLING WATER PASSAGE STRUCTURE OF OUTBOARD MOTOR

CROSS REFERENCE TO RELATED APPLICATION

This application is based upon and claims the benefit of priority of the prior Japanese Patent Application No. 2015-026188, filed Feb. 13, 2015, the entire contents of which are incorporated herein by reference.

BACKGROUND OF THE INVENTION

Field of the Invention

The present invention relates to a cooling water passage structure of an outboard motor for cooling an engine mounted on the outboard motor by using cooling water.

Description of the Related Art

As shown in FIG. 9, a cooling water passage structure of an outboard motor disclosed in Patent Document 1 (Japanese Patent Laid-Open No. 2013-124592) includes a cooling water passage which causes sea water, river water, or the like taken in through an intake 101 of the outboard motor and led to a water passage 103 by a water pump 102 to flow as cooling water through a cylinder head water jacket 104 of a cylinder head, exhaust passage periphery water jacket 105 of an exhaust passage containing an exhaust purification catalyst, and a cylinder periphery water jacket 106 of a cylinder block in order.

In the cylinder head water jacket 104, a first combustion chamber periphery water jacket 107A and a second combustion chamber periphery water jacket 107B located on an upstream side are communicated with an exhaust manifold periphery water jacket 108 located on a downstream side. The first combustion chamber periphery water jacket 107A, second combustion chamber periphery water jacket 107B, and exhaust manifold periphery water jacket 108 are so designed as to pass cooling water upward from a lower side.

In the case of the cooling water passage structure of an outboard motor described in Patent Document 1, in a peripheral portion of a combustion chamber in the cylinder head, a temperature of a portion in the first combustion chamber periphery water jacket 107A and second combustion chamber periphery water jacket 107B which corresponds to a lowermost cylinder and into which cooling water flows first is lower than that of portions corresponding to the other cylinders, and hence, is overcooled.

Furthermore, in a peripheral portion of an exhaust manifold of the cylinder head, cooling water yet to be cooled in the first combustion chamber periphery water jacket 107A and second combustion chamber periphery water jacket 107B flows into that peripheral portion of the exhaust manifold periphery water jacket 108 which corresponds to the lowermost cylinder, and accordingly, a temperature of such portion is lower than portions corresponding to the other cylinders, and hence, is overcooled.

Consequently, exhaust gas flowing through the exhaust manifold is cooled excessively, steam in the exhaust gas condenses, and droplets are produced in the exhaust manifold.

SUMMARY OF THE INVENTION

The present invention was conceived in consideration of the circumstances mentioned above, and an object thereof is to provide a cooling water passage structure of an outboard motor, capable of preventing steam in exhaust gas from being condensed by excessive cooling of the exhaust gas flowing through an exhaust passage, preventing an oxygen sensor installed in the exhaust passage from getting wet, and thereby improving durability of the oxygen sensor.

The above and other objects can be achieved according to the present invention by providing, in one preferred embodiment, a cooling water passage structure of an outboard motor which includes a four-stroke engine, an intake unit having an intake port configured to take in water from an underwater, and a water passage configured to supply the water taken in through the intake unit to the four-stroke engine as cooling water, wherein the four-stroke engine includes a cylinder block in which a cylinder is formed by extending in a horizontal direction, a cylinder head fixed to the cylinder block so as to cover the cylinder, configured to form a combustion chamber together with the cylinder, and provided with an exhaust port configured to discharge exhaust gas in communication with the combustion chamber, and an exhaust passage connected to the exhaust port so as to lead the exhaust gas to outside the engine, wherein a combustion chamber periphery water jacket through which the cooling water flows around the combustion chamber and an exhaust port periphery water jacket through which the cooling water flows around the exhaust port are formed in the cylinder head, a cylinder periphery water jacket through which the cooling water flows around the cylinder is formed in the cylinder block, and an exhaust passage periphery water jacket through which the cooling water flows around the exhaust passage is formed around the exhaust passage, and wherein the water jackets are connected such that the cooling water from the water passage will flow through the combustion chamber periphery water jacket, the exhaust port periphery water jacket, the cylinder periphery water jacket, and the exhaust passage periphery water jacket in order.

According to the preferred embodiment of the present invention, the cooling water from the water passage flows through the combustion chamber periphery water jacket, the exhaust port periphery water jacket, the cylinder periphery water jacket, and the exhaust passage periphery water jacket in order. Accordingly, the cooling water heated in the combustion chamber periphery water jacket and exhaust port periphery water jacket in sequence flows through the exhaust passage periphery water jacket. Therefore, the exhaust gas flowing through the exhaust passage is not cooled excessively by the cooling water, which makes it possible to prevent condensation of the steam contained in the exhaust gas, and hence, makes it possible to prevent an oxygen sensor installed in the exhaust passage from getting wet, thereby improving the durability of the oxygen sensor.

The nature and further characteristic features of the present invention will be made clearer from the following description made with reference to the accompanying drawings.

DESCRIPTION OF THE PREFERRED EMBODIMENT

An embodiment of the present invention will be described hereunder with reference to the accompanying drawings. It is to be noted that, in the following descriptions, terms "upper", "lower", "right", "left", "forward", "rearward" and the like terms indicating directions are used with reference to the illustrated state of the drawings or a state mounted to a hull.

Figure 1:
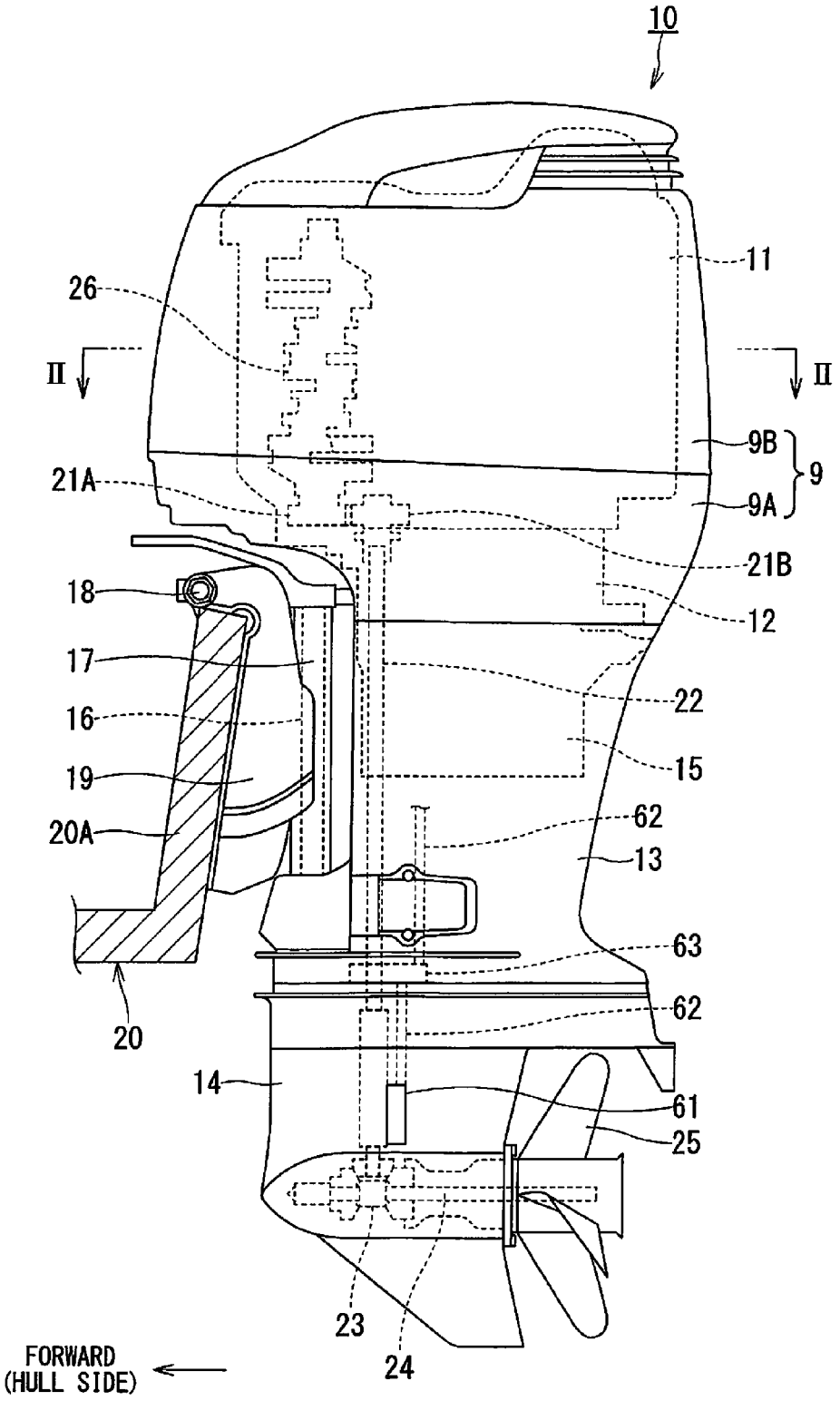
FIG. 1 is a left side view showing an outboard motor to which an embodiment of a cooling water passage structure for the outboard motor according to the present invention is applied.

FIG. 1 is a left side view showing an outboard motor to which an embodiment of a cooling water passage structure of the outboard motor according to the present invention is applied. The outboard motor 10 shown in FIG. 1 is equipped with an engine holder 12, on which an engine 11 is mounted. The engine 11 is a vertical engine in which a crankshaft 26 (described hereinlater) is mounted substantially perpendicularly (i.e., vertically). A drive shaft housing 13 and a gear case 14 are assembled in sequence under the engine holder 12.

In FIG. 1, an oil pan 15 is located under the engine holder 12 in which a lubricating oil is reserved. A vertically dividable engine cover 9 includes a lower engine cover 9A and an upper engine cover 9B so as to cover the engine 11 and engine holder 12.

The outboard motor 10 is supported pivotally in a horizontal direction by means of a pilot shaft 16 pivotally supported on a swivel bracket 17. The swivel bracket 17 is supported on a swivel shaft 18 pivotally in a vertical direction with respect to a clamp bracket 19, which is attached to a stern (transom) 20A of a hull 20. Consequently, the outboard motor 10 is mounted on the hull 20 swingably in a horizontal direction (steering direction) and vertical direction (trim and tilt direction).

A driving force generated on the crankshaft 26 of the engine 11 is transmitted through reduction gears 21A and 21B to a drive shaft 22 disposed so as to extend substantially vertically in the drive shaft housing 13 and gear case 14 and is then transmitted through a shift mechanism 23 and propeller shaft 24 disposed in the gear case 14 to a propeller 25, thereby turning the propeller 25 in a forward or reverse direction. According to such arrangement, the outboard motor 10 causes the hull 20 to move forward or backward.

Figure 2:
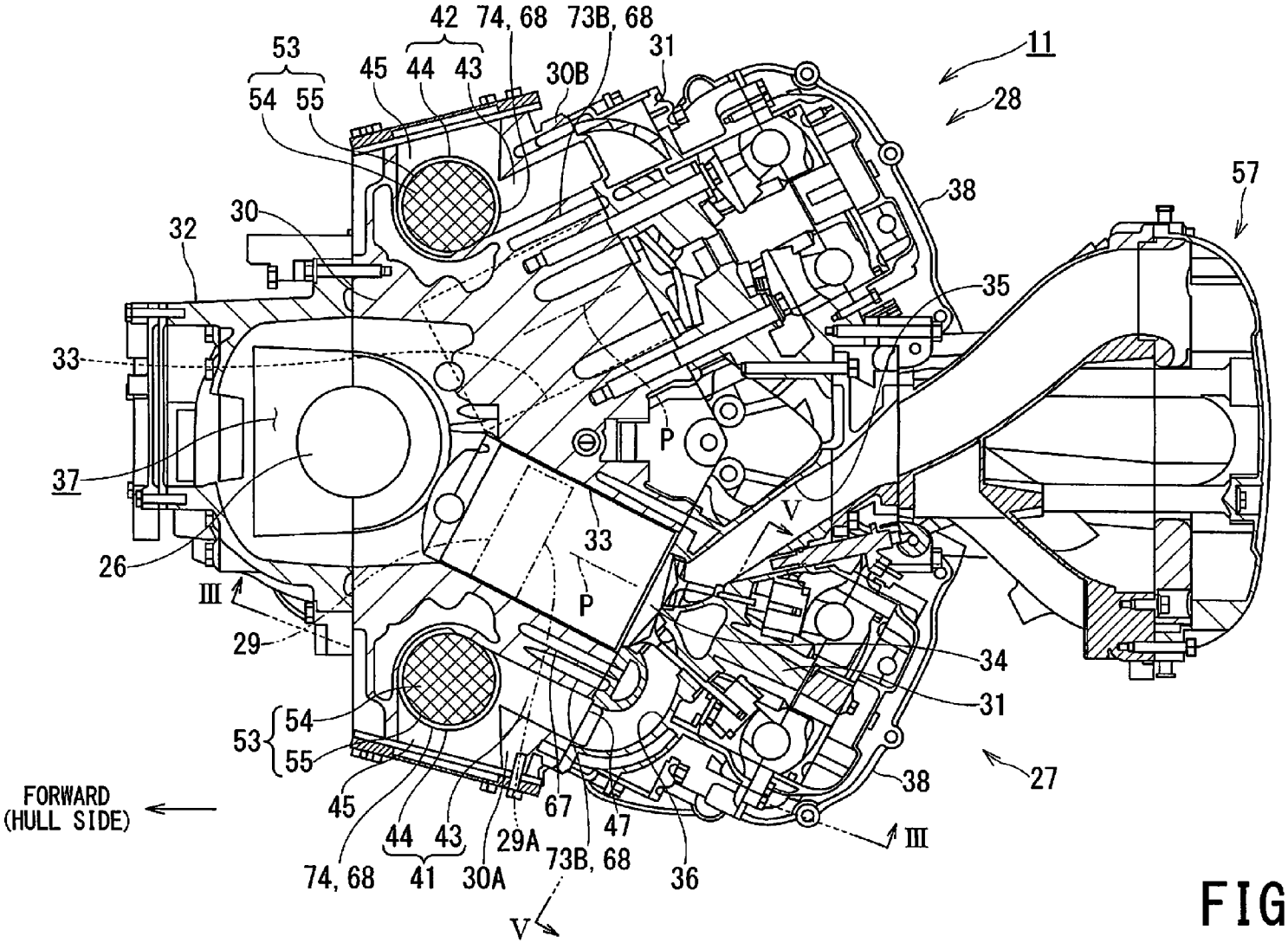
FIG. 2 is a sectional view of the outboard motor of FIG. 1 taken along the line II-II.

As shown in FIGS. 1 and 2, the engine 11 is a V-type four-stroke-cycle engine which includes the crankshaft 26 extending in a vertical direction, a left bank 27 extending diagonally left rearward, and a right bank 28 extending diagonally right rearward. In such V-type engine, the left bank 27 is composed of a cylinder head 31 and a cylinder head cover 38 placed in sequence behind a left bank portion 30A of a cylinder block 30, and the right bank 28 is composed of a cylinder head 31 and a cylinder head cover 38 placed in sequence behind a right bank portion 30B of the cylinder block 30. Further, a crankcase 32 is placed in front of the cylinder block 30.

As shown in FIG. 2, cylinders 33 are formed in a horizontal direction inside the left bank portion 30A of the cylinder block 30, extending diagonally left rearward. Cylinders 33 are also formed in a horizontal direction inside the right bank portion 30B of the cylinder block 30, extending diagonally right rearward. Pistons 29 are reciprocally located in the cylinders 33 and coupled to the crankshaft 26 via connection rods, not shown.

Along cylinder axes P of the cylinders 33 in the left bank portion 30A and right bank portion 30B of the cylinder block 30, the cylinder heads 31 are fixed, respectively, to the left bank portion 30A and right bank portion 30B so as to cover the cylinders 33, and concurrently, to form combustion chambers 34 in conjunction with respective cylinders 33 in the left bank portion 30A and right bank portion 30B.

Moreover, in the left bank portion 30A and right bank portion 30B of the cylinder block 30, intake ports 35 communicated with the combustion chambers 34 are formed in the cylinder heads 31 inwardly of the cylinder axes P of the cylinders 33 in a width direction of the outboard motor. Furthermore, in the cylinder heads 31, exhaust ports 36 communicated with the combustion chambers 34 are formed in the cylinder heads 31 outwardly of the cylinder axes P of the cylinders 33 in the left bank portion 30A and right bank portion 30B of the cylinder block 30 in the width direction of the outboard motor.

Figure 3:
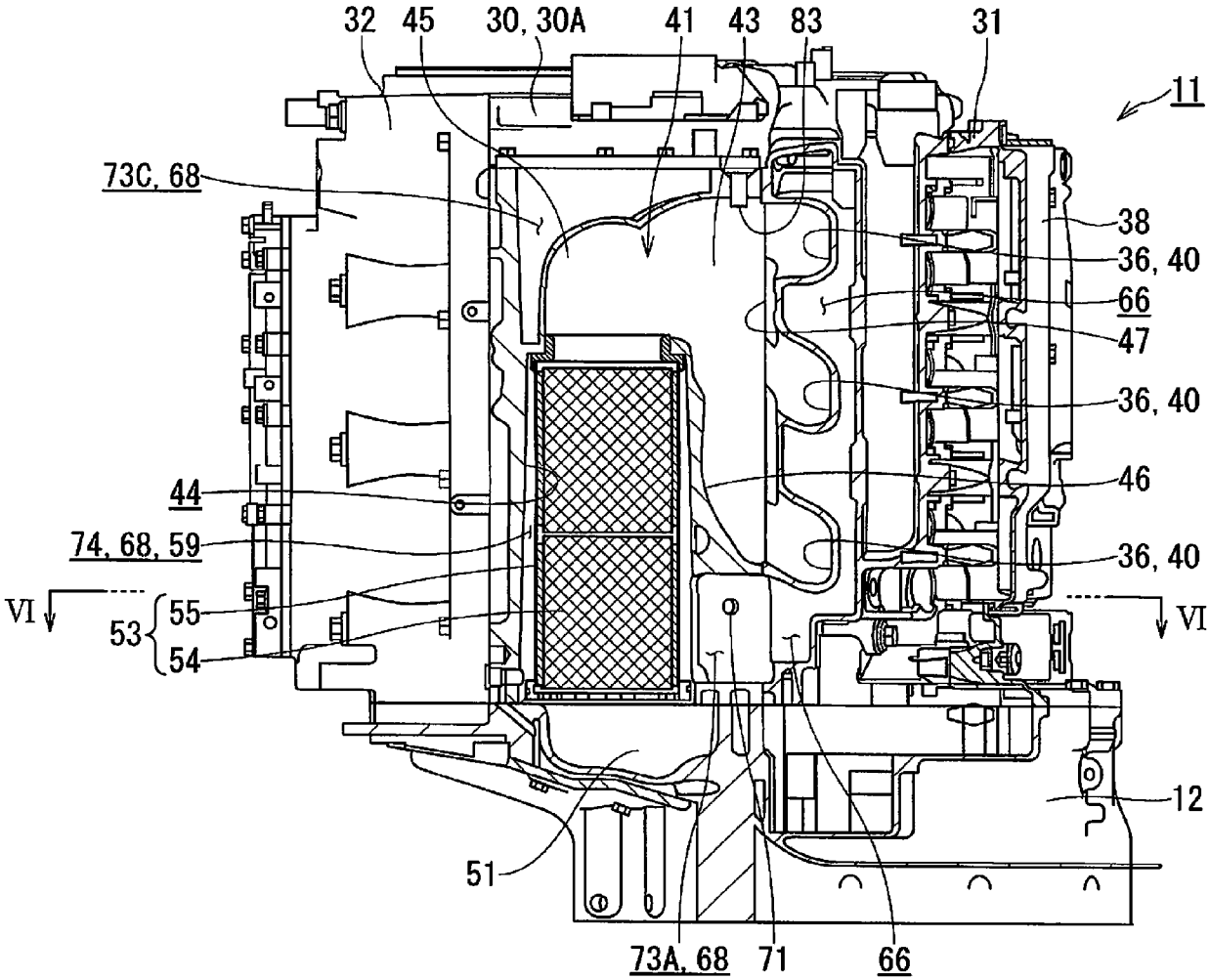
FIG. 3 is a sectional view taken along the line III-III in FIG. 2.
Figure 4:
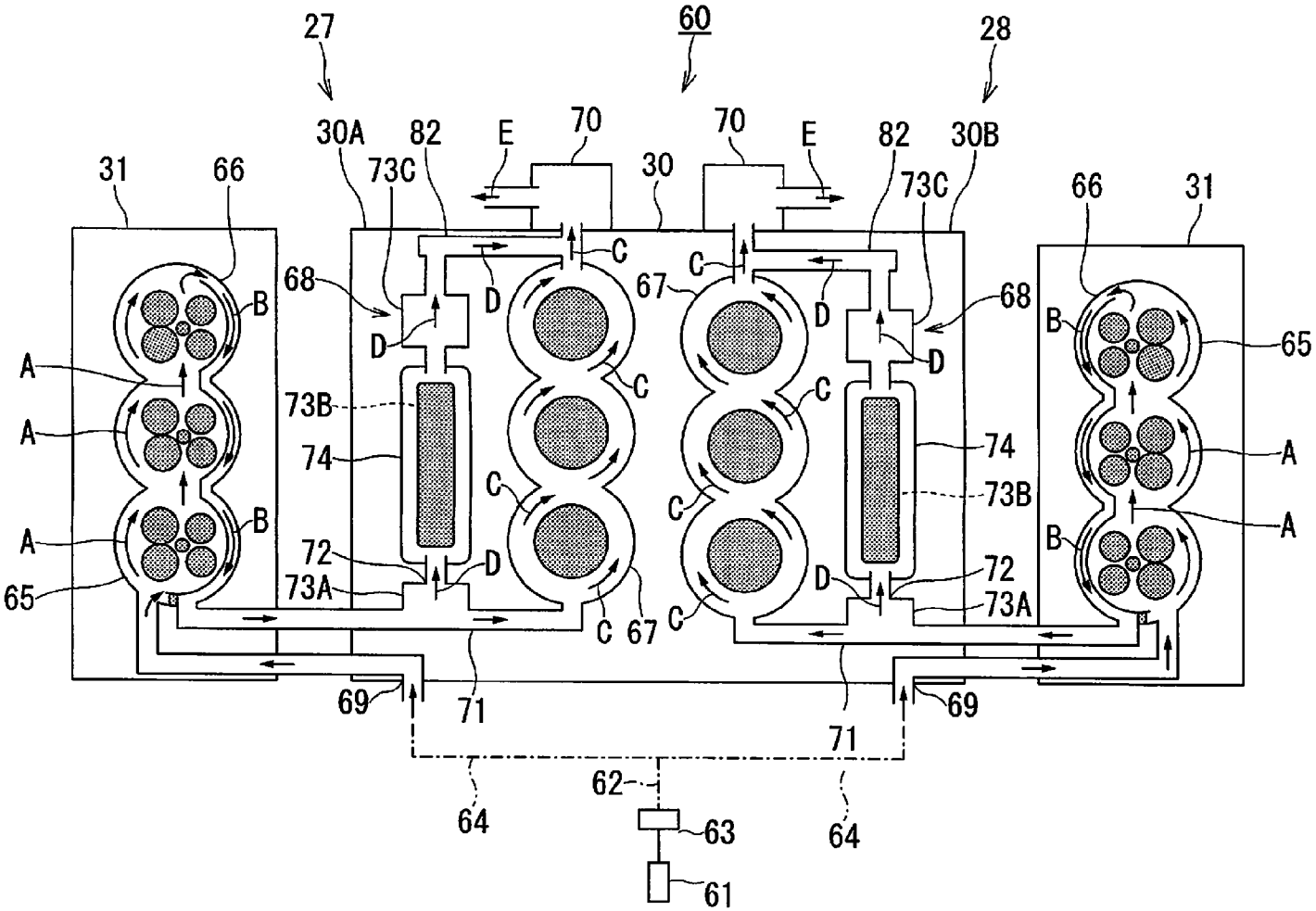
FIG. 4 is a schematic diagram showing the cooling water passage structure of an engine of the outboard motor shown in FIGS. 2 and 3.

The crankcase 32 is coupled to the cylinder block 30, thereby forming a crank chamber 37 in conjunction with the cylinder block 30, and the crankshaft 26 is housed in the crank chamber 37. Herein, in each of the above-mentioned left bank 27 and right bank 28, plural cylinder assemblies (i.e., piston-cylinder assemblies) 40 each equipped with a cylinder 33, a combustion chamber 34, an intake port 35, and an exhaust port 36 are arranged side by side in a vertical direction as shown in FIGS. 3 and 4. According to the present embodiment, three cylinder assemblies 40 are arranged side by side in the vertical direction in each of the right bank 28 and left bank 27, thus constituting the engine 11 as a V-type six-cylinder four-stroke engine.

As shown in FIGS. 2 and 3, the respective exhaust ports 36 of the plural cylinder assemblies 40 in the left bank 27 are connected with a left exhaust passage 41 adapted to lead the exhaust gas from the exhaust ports 36 out of the engine 11. The left exhaust passage 41 is formed integrally with the left bank portion 30A of the cylinder block 30. Further, the respective exhaust ports 36 of the plural cylinder assemblies 40 in the right bank 28 are connected with a right exhaust passage 42 adapted to lead the exhaust gas from the exhaust ports 36 out of the engine 11. The right exhaust passage 42 is formed integrally with the right bank portion 30B of the cylinder block 30. Each of the left exhaust passage 41 and the right exhaust passage 42 includes an exhaust manifold 43 serving as a first exhaust passage section and a catalyst storage space 44 serving as a second exhaust passage section.

The exhaust manifold 43 is mounted on at least one of both the lateral sides, in the present embodiment, on both sides, of the cylinder block 30 in the width direction. That is, the exhaust manifold 43 of the left exhaust passage 41 is provided in lateral part of the cylinder block 30 on the left side in the width direction (left bank portion 30A), corresponding to the left bank 27, while the exhaust manifold 43 of the right exhaust passage 42 is provided in lateral part of the cylinder block 30 on the right side in the width direction (right bank portion 30B), corresponding to the right bank 28.

Furthermore, as shown in FIG. 3, in particular, the exhaust manifolds 43 collect the exhaust gas discharged from the respective exhaust ports 36 of the plural cylinder assemblies 40.

In addition, a plurality of exhaust guiding portions 46 are provided for the respective exhaust manifolds 43 of the left exhaust passage 41 and right exhaust passage 42 so as to guide the exhaust gas discharged from the respective exhaust ports 36 of the plural cylinder assemblies 40 to connecting portions 45 between the exhaust manifolds 43 and catalyst storage chambers 44. Each of the exhaust guiding portions 46 is formed as a vertical plane opposed to a joint surface (parting plane) 47 between the cylinder block 30 and the cylinder head 31. The exhaust gas flowing in the exhaust port 36 is guided upward by the exhaust guiding portion 46 in the exhaust manifold 43, and the exhaust gas then reaches the connecting portion 45 between the exhaust manifold 43 and the catalyst storage chamber 44.

As shown in FIG. 2, the catalyst storage chamber 44 in the left exhaust passage 41 is formed integrally on the left bank portion 30A of the cylinder block 30 and the catalyst storage chamber 44 in the right exhaust passage 42 is formed integrally on the right bank portion 30B of the cylinder block 30, both being, for example, substantially circular in passage section.

As shown in FIG. 3, the catalyst storage chambers 44 are communicated with both the connecting portions 45 of the exhaust manifolds 43 and an exhaust passage 51 of the engine holder 12, thereby connecting exhaust manifolds 43 with an exhaust silencing chamber (i.e., muffler), not shown, inside the drive shaft housing 13 installed outside the engine 11. Then, catalytic converters 53 having, for example, a circular shape in section for purifying the exhaust gas are installed and housed in the catalyst storage chambers 44.

Each catalytic converter 53 is configured such that a catalyst carrier 54 formed into, for example, a columnar shape and equipped with an exhaust purification function is housed in a catalyst tube 55, having a cylindrical shape, for example. When the catalyst carrier 54 comes into contact with exhaust gas, it chemically changes toxic substances such as carbon monoxide, hydrocarbon, nitrogen oxides, and the like contained in the exhaust gas into water, carbon dioxide, nitrogen or the like via oxidation-reduction reactions to thereby purify the exhaust gas.

Accordingly, the exhaust gas produced in the combustion chambers 34 of the plural cylinder assemblies 40 in the left bank 27 and right bank 28 of the engine 11 shown in FIG. 2, flows through the exhaust ports 36 of the cylinder assemblies 40 in the left bank 27 and right bank 28 and into the respective exhaust manifolds 43 of the left exhaust passage 41 and right exhaust passage 42.

As shown in FIG. 3, the exhaust gas flowing into each exhaust manifold 43 ascends by being guided by the exhaust guiding portion 46, and then reaches the connecting portion 45 between the exhaust manifold 43 and the catalyst storage chamber 44. The exhaust gas flows downward in the connecting portion 45 into the catalytic converter 53 in the catalyst storage chamber 44 in order to be purified.

The exhaust gas purified by the catalytic converters 53 flows downward into the exhaust silencing chamber of the drive shaft housing 13, thereby being expanded and silenced (muffled) therein. Subsequently, the exhaust gas flows in an exhaust passage, not shown, formed around the propeller shaft 24 in the gear case 14 shown in FIG. 1 and is discharged into water from a center of the propeller 25.

In FIG. 2, reference numeral 57 denotes an intake manifold connected to the intake port 35 of the engine 11 and adapted to introduce fuel/air mixture into the combustion chamber 34 through the intake port 35.

Herein, as shown in FIG. 4, the outboard motor 10 shown in FIG. 1 is provided with a cooling water passage structure 60 to cool the engine 11 by leading water, as cooling water, to the engine 11 from a sea or a river on which the hull 20 with the outboard motor 10 installed thereon navigates. The cooling water passage structure 60 includes an intake port 61 formed in the gear case 14, a water passage 62 installed in the drive shaft housing 13 and provided with a water pump 63, a combustion chamber periphery water jackets 65 and an exhaust port periphery water jackets 66 formed in the cylinder heads 31 on the left bank 27 and right bank 28 of the engine 11, and cylinder periphery water jackets 67 and exhaust passage periphery water jackets 68 formed in the left bank portion 30A and right bank portion 30B of the cylinder block 30.

As the gear case 14 is located in water during the use and operation of the outboard motor 10, the intake port 61 is formed in the gear case 14 so as to be able to take in water by being located underwater. Furthermore, the water passage 62 installed in the drive shaft housing 13 includes the water pump 63 and has its lower end and upper end connected to the intake port 61 and a cooling water passage 64 of the engine holder 12, respectively. The water pump 63 is installed in the drive shaft housing 13 near a mating surface between the drive shaft housing 13 and the gear case 14 and driven by the drive shaft 22.

The water passage 62 takes in water through the intake port 61 when the water pump 63 operates, and supplies the water as cooling water to cooling water inlet ports 69 formed in the left bank portion 30A and right bank portion 30B of the cylinder block 30 through the cooling water passage 64 of the engine holder 12.

Figure 5:
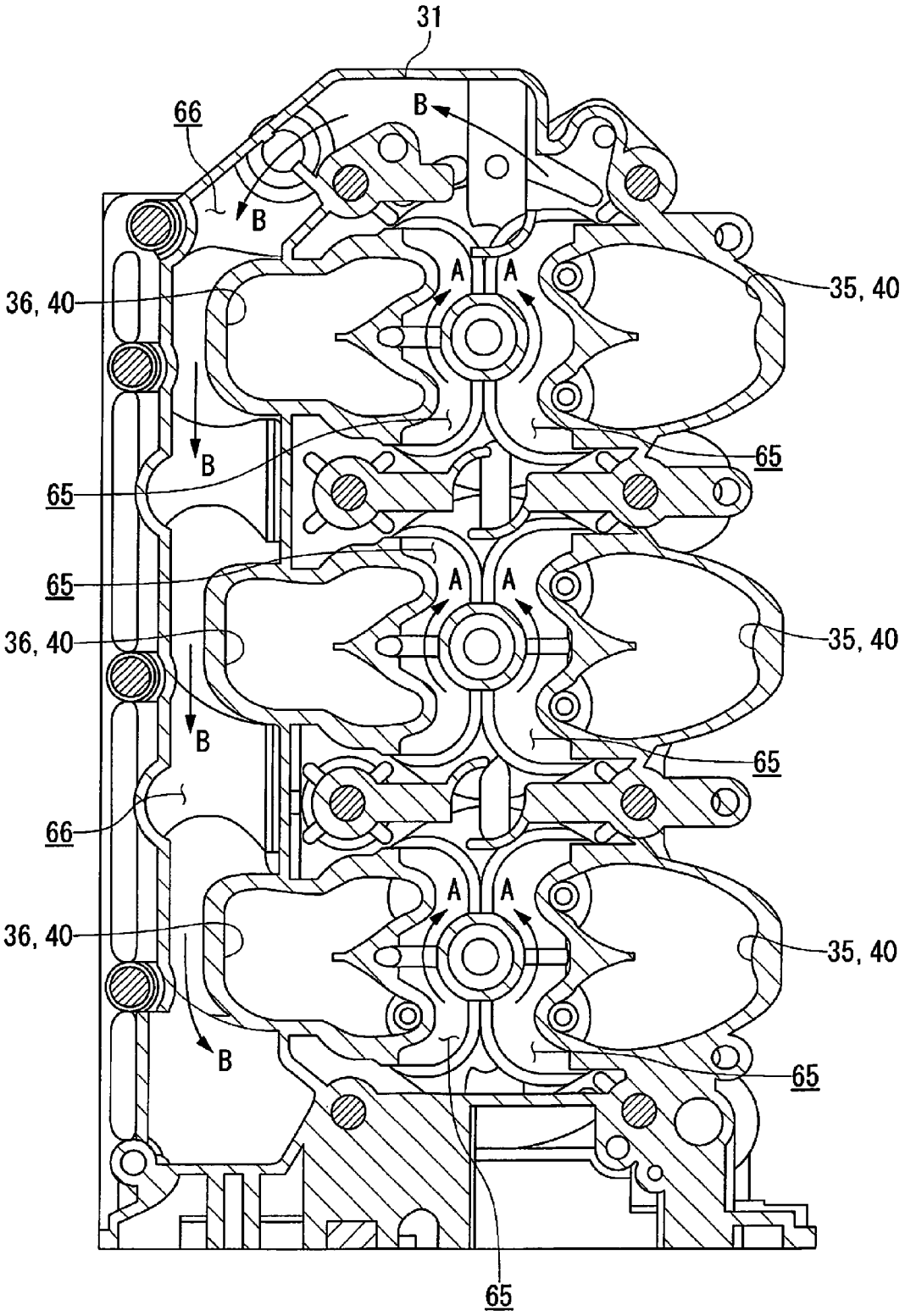
FIG. 5 is a sectional view taken along the line V-V in FIG. 2 for showing a combustion chamber periphery water jacket and exhaust port periphery water jacket of FIG. 4.

The cooling water supplied to the cooling water inlet ports 69 in the left bank portion 30A and right bank portion 30B flows first through the combustion chamber periphery water jackets 65 in the cylinder heads 31 on the left bank 27 and right bank 28 as shown in FIGS. 4 and 5 without cooling the cylinder block 30 to thereby cool the peripheries of the combustion chambers 34 of the plural cylinder assemblies 40 in the cylinder heads 31 on the left bank 27 and right bank 28. Then, the cooling water flows through the exhaust port periphery water jackets 66 in the cylinder heads 31 on the left bank 27 and the right bank 28 to thereby cool the peripheries of the exhaust ports 36 of the plural cylinder assemblies 40 in the cylinder heads 31 on the left bank 27 and the right bank 28.

Figure 7:
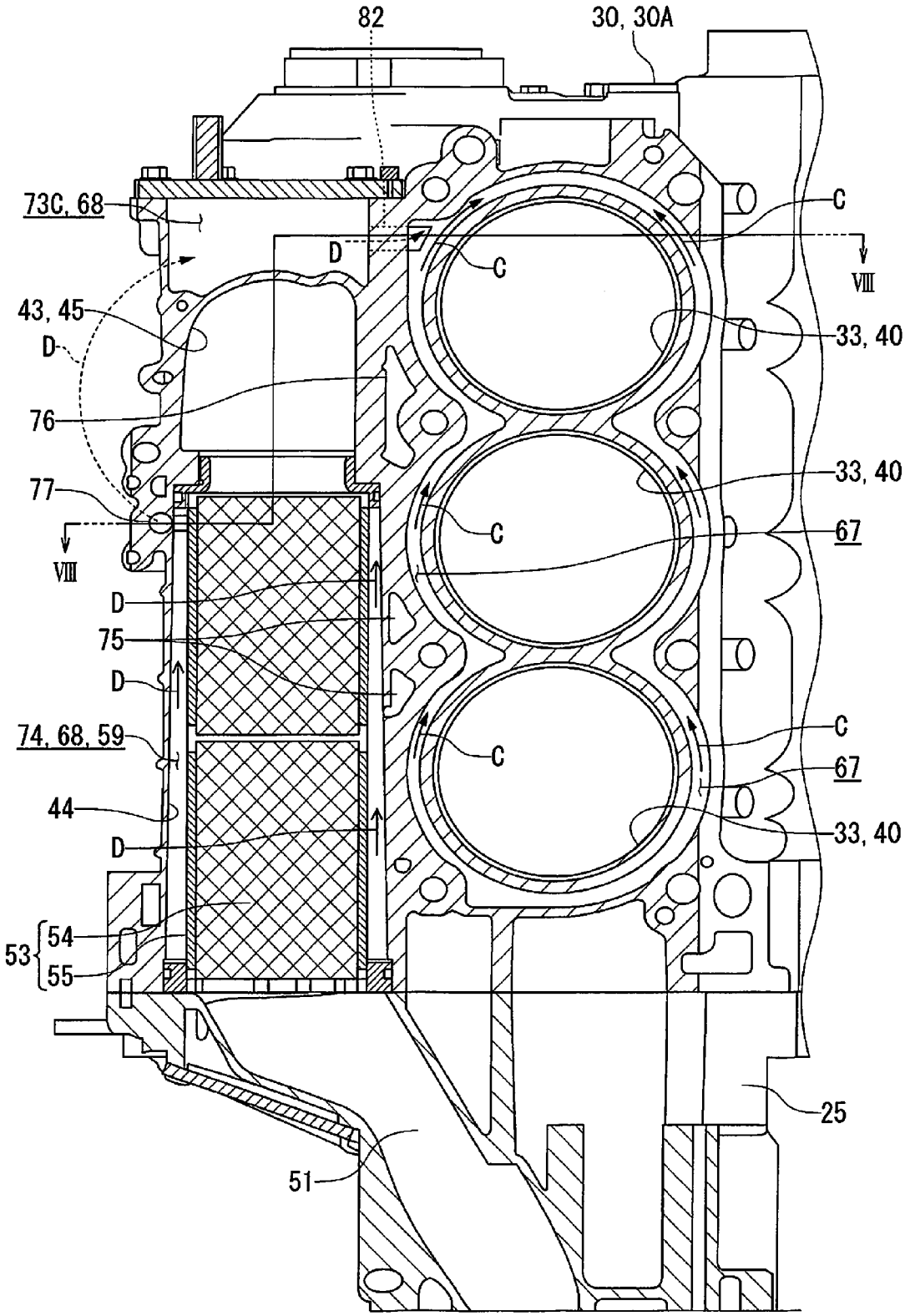
FIG. 7 is a sectional view taken along the line VII-VII in FIG. 8, for showing the cylinder periphery water jacket and exhaust passage periphery water jacket (third exhaust manifold periphery water jacket and catalyst periphery water jacket) of FIG. 4.

Then, as shown in FIGS. 4 and 7, the cooling water flows simultaneously through the cylinder periphery water jackets 67 and the exhaust passage periphery water jackets 68 in the left bank portion 30A and the right bank portion 30B of the cylinder block 30 in parallel to thereby cool the peripheries of the cylinders 33 of the plural cylinder assemblies 40 in the left bank portion 30A and the right bank portion 30B of the cylinder block 30 as well as the peripheries of the left exhaust passage 41 and the right exhaust passage 42 (especially, peripheries of the exhaust manifolds 43 in the left exhaust passage 41 and the right exhaust passage 42 as well as the catalyst 53).

Subsequently, the cooling water is discharged out of the engine 11 through a thermostat case 70 of the engine 11. In order for the cooling water to flow as described above, the combustion chamber periphery water jacket 65, the exhaust port periphery water jackets 66, the cylinder periphery water jacket 67, and the exhaust passage periphery water jacket 68 are connected in sequence.

The combustion chamber periphery water jackets 65 formed in the cylinder heads 31 on the left bank 27 and the right bank 28 are formed around the combustion chambers 34 of the plural cylinder assemblies 40 in the cylinder heads 31 by being communicated with each other as shown in FIGS. 4 and 5. In the combustion chamber periphery water jacket 65, as indicated by arrow "A", the cooling water flows in from the side of the lowermost cylinder assembly 40, ascends, and flows around the combustion chambers 34 in sequence to the side of an uppermost cylinder assembly 40.

Consequently, the peripheries of the combustion chambers 34 in the cylinder heads 31 are cooled in sequence from the lowermost cylinder assembly 40 to the uppermost cylinder assembly 40.

The exhaust port periphery water jackets 66 formed in the cylinder heads 31 on the left bank 27 and the right bank 28 are formed around the exhaust ports 36 of the plural cylinder assemblies 40 in the cylinder heads 31 by being communicated with each other as shown in FIGS. 3, 4, and 5. As indicated by arrow "B", on the side of the uppermost cylinder unit 40, the cooling water from the combustion chamber periphery water jacket 65 flows into the exhaust port periphery water jacket 66, descends, and flows around the exhaust ports 36 in sequence to the side of the lowermost cylinder assembly 40.

Consequently, the peripheries of the exhaust ports 36 in the cylinder heads 31 are cooled in sequence from the uppermost cylinder assembly 40 to the lowermost cylinder assembly 40.

Figure 6:
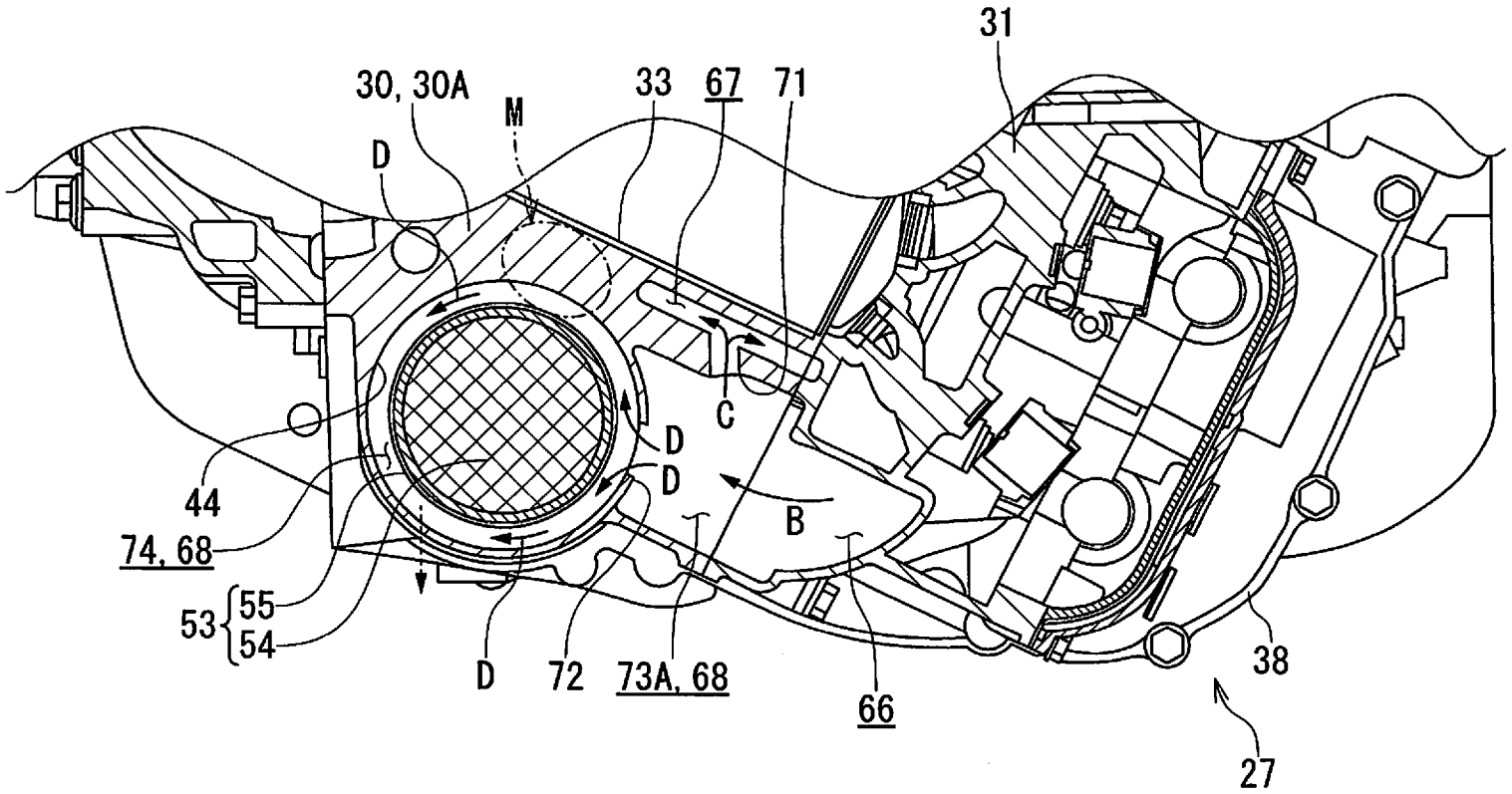
FIG. 6 is a sectional view taken along the line VI-VI in FIG. 3 for showing a manner how the exhaust port periphery water jacket is connected with a cylinder periphery water jacket and exhaust passage periphery water jacket (first exhaust manifold periphery water jacket and catalyst periphery water jacket) shown in FIG. 4.

As shown in FIGS. 3, 4, and 6, a lowermost portion (on the side of the lowermost cylinder unit 40) of the exhaust port periphery water jacket 66 formed in the cylinder head 31 on each of the left bank 27 and the right bank 28 is communicated with a first exhaust manifold periphery water jacket 73A (described hereinlater) of the exhaust passage periphery water jacket 68 in the corresponding one of the left bank portion 30A and the right bank portion 30B of the cylinder block 30.

The first exhaust manifold periphery water jackets 73A are communicated with lowermost portions of the cylinder periphery water jackets 67 in the left bank portion 30A and the right bank portion 30B of the cylinder block 30 through a communicating path 71 between the left bank portion 30A and the right bank portion 30B and communicated with catalyst periphery water jackets 74 (described hereinlater) of the exhaust passage periphery water jackets 68 in the left bank portion 30A and the right bank portion 30B of the cylinder block 30 through communicating paths 72 of the left bank portion 30A and the right bank portion 30B.

Further, as shown in FIGS. 4, 6, and 7, the cylinder periphery water jackets 67 formed in the left bank portion 30A and the right bank portion 30B of the cylinder block 30 are formed around the cylinders 33 of the plural cylinder assemblies 40 in the left bank portion 30A and the right bank portion 30B of the cylinder block 30 by being communicated with each other. The cooling water flowing into the cylinder periphery water jackets 67 from the lowermost portions (on the side of the lowermost cylinder units 40) of the exhaust port periphery water jackets 66 through the first exhaust manifold periphery water jackets 73A and communicating path 71 flows into the side of the lowermost cylinder assemblies 40, ascends, and flows around the cylinders 33 in sequence to the side of the uppermost cylinder assembly 40, as indicated by arrow "C".

Consequently, the peripheries of the cylinders 33 in the left bank portion 30A and the right bank portion 30B of the cylinder block 30, are cooled in sequence from the lowermost cylinder assembly 40 to the uppermost cylinder assembly 40.

As shown in FIGS. 2 to 4, 6, and 7, the exhaust passage periphery water jacket 68 formed in each of the left bank portion 30A and the right bank portion 30B of the cylinder block 30 includes the first exhaust manifold periphery water jacket 73A, a second exhaust manifold periphery water jacket 73B, a third exhaust manifold periphery water jacket 73C, and the catalyst periphery water jacket 74, which are communicated with one another.

Furthermore, the exhaust passage periphery water jacket 68 (actually, the second exhaust manifold periphery water jacket 73B, the third exhaust manifold periphery water jacket 73C, and the catalyst periphery water jacket 74) is configured into a separate circuit by being connected in parallel with the cylinder periphery water jacket 67.

That is, as shown in FIGS. 3 and 6, in particular, the first exhaust manifold periphery water jacket 73A is formed around a lower portion of the exhaust manifold 43 formed in each of the left bank portion 30A and the right bank portion 30B of the cylinder block 30 and is communicated with the catalyst periphery water jacket 74 through the communicating path 72 as described above. The catalyst periphery water jacket 74 is formed by a gap 59 provided between an inner wall surface of the catalyst storage chamber 44 in each of the left bank portion 30A and the right bank portion 30B of the cylinder block 30 and an outer lateral surface of the catalyst tube 55 of the catalytic converter 53 and is provided around the catalytic converter 53.

As shown in FIGS. 2, 3, and 7, in particular, the second exhaust manifold periphery water jacket 73B is formed around that part of the exhaust manifold 43 formed in each of the left bank portion 30A and right bank portion 30B of the cylinder block 30 which is located on the side of the cylinders 33, with a lower part of the water jacket 73B being communicated with the catalyst periphery water jacket 74 through a communicating path 75 and an upper part of the water jacket 73B being communicated with the third exhaust manifold periphery water jacket 73C through a communicating path 76.

As shown in FIGS. 3 and 7, in particular, the third exhaust manifold periphery water jacket 73C is formed around an upper portion (connecting portion 45) of the exhaust manifold 43 formed in each of the left bank portion 30A and the right bank portion 30B of the cylinder block 30. The third exhaust manifold periphery water jacket 73C is communicated with the second exhaust manifold periphery water jacket 73B through the communicating path 76 as described above as well as communicated with the catalyst periphery water jacket 74 through a communicating path 77, a communicating path 80 between an exhaust passage lid 78 and the water jacket lid 79, and a communicating path 81 as shown in FIG. 8.

Thus, in the exhaust passage periphery water jacket 68 described above, as indicated by arrow "D" in FIGS. 4, 6, 7, and 8, the cooling water from the lowermost portions of the exhaust port periphery water jackets 66 flows into the first exhaust manifold periphery water jacket 73A, and then flows into the catalyst periphery water jacket 74 through the communicating path 72 and ascends therein while flowing into and then ascending in the second exhaust manifold periphery water jacket 73B through the communicating path 75 in parallel to the flow in the catalyst periphery water jacket 74. The cooling water in the catalyst periphery water jacket 74 flows into the third exhaust manifold periphery water jacket 73C through the communicating paths 77, 80, and 81.

The cooling water in the second exhaust manifold periphery water jacket 73B also flows into the third exhaust manifold periphery water jacket 73C through the communicating path 76. The cooling water flowing through the exhaust passage periphery water jacket 68 in this way cools the periphery of the exhaust manifold 43 in each of the left exhaust passage 41 and the right exhaust passage 42 as well as the catalyst 53 in each of the left exhaust passage 41 and the right exhaust passage 42.

Figure 8:
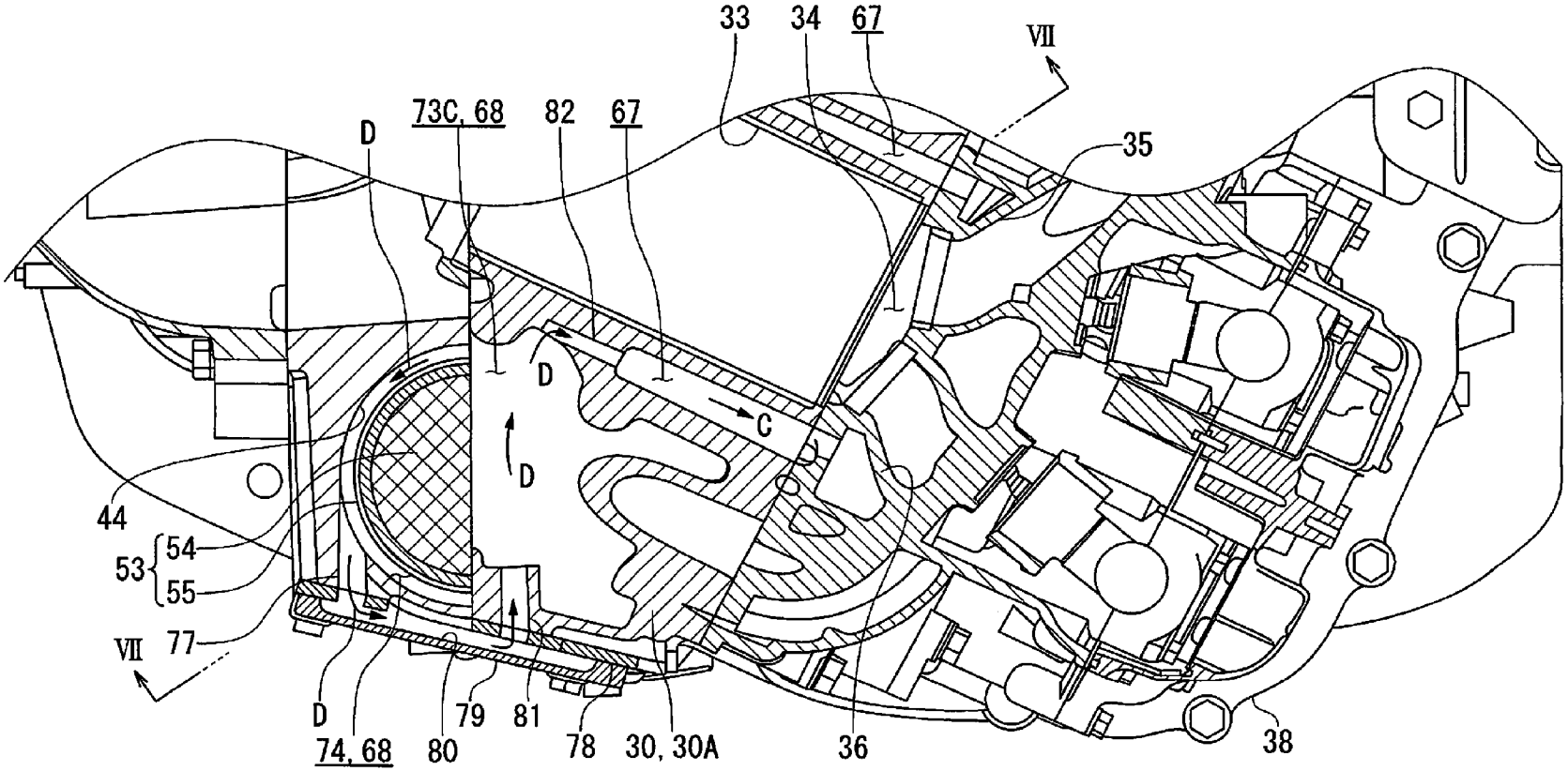
FIG. 8 is a sectional view taken along the line VIII-VIII in FIG. 7, for showing a manner how the cylinder periphery water jacket and exhaust passage periphery water jacket (third exhaust manifold periphery water jacket) of FIG. 4 are connected with each other.
Figure 9:
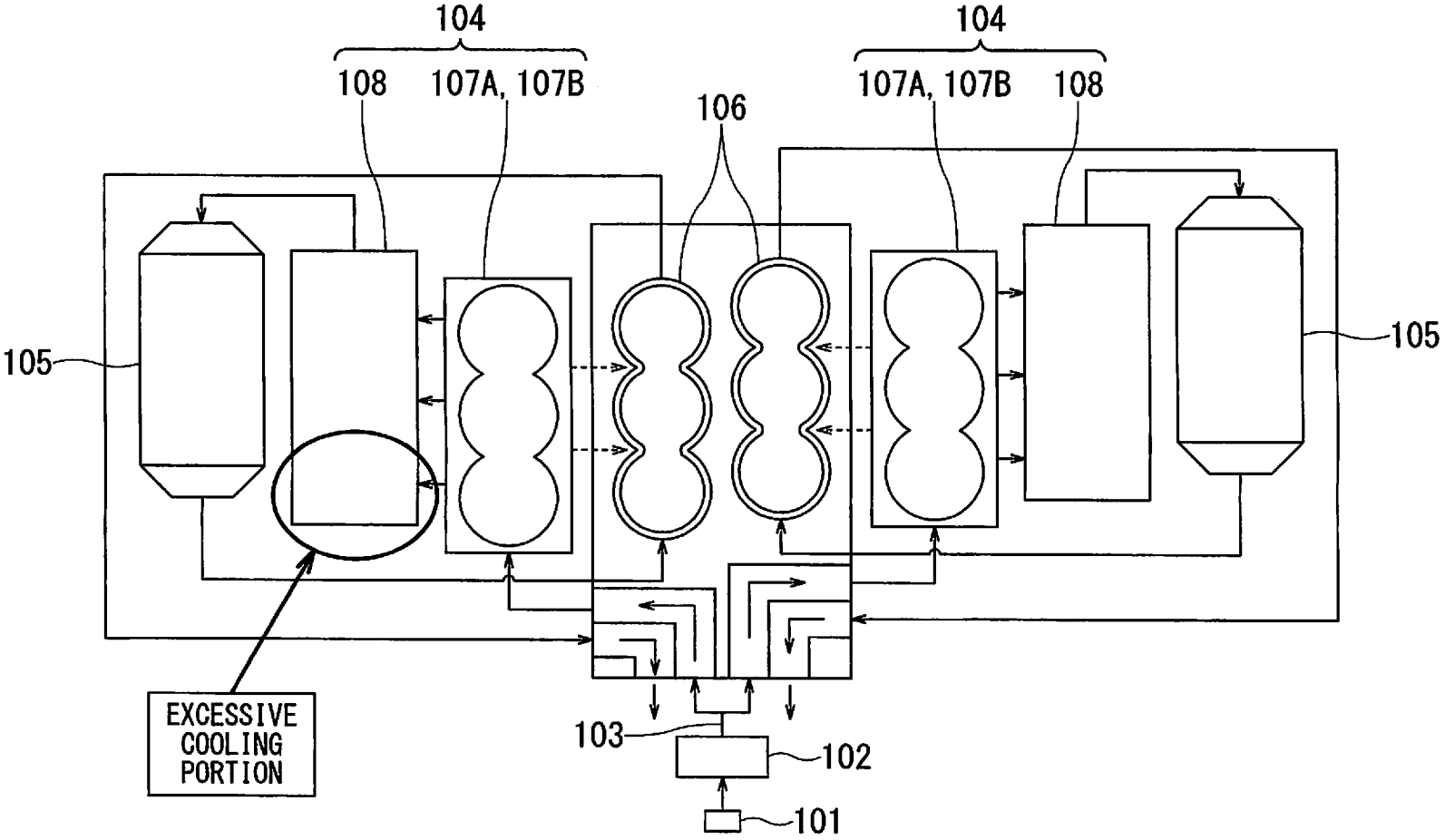
FIG. 9 is a diagram showing a conventional cooling water passage structure for an outboard motor.

As shown in FIGS. 4 and 8, the cooling water flowing into the third exhaust manifold periphery water jacket 73C flows through a communicating path 82 formed in each of the left bank portion 30A and the right bank portion 30B of the cylinder block 30 and joins with the cooling water flowing through the uppermost portion (on the side of the uppermost cylinder unit 40) of the cylinder periphery water jacket 67. The joined cooling water flows into the thermostat case 70 as indicated by arrow "E" in FIG. 4 and is discharged out of the engine 11 when a thermostat contained in the thermostat case 70, not shown, opens.

Then, as shown in FIG. 3, a portion of the exhaust manifold 43 in each of the left exhaust passage 41 and the right exhaust passage 42, i.e., a portion of the exhaust manifold 43 which is close to the exhaust guiding portion 46, is positioned adjacent to the catalyst periphery water jacket 74 of the exhaust passage periphery water jacket 68.

Consequently, the cooling water flowing through the catalyst periphery water jacket 74 has a function to cool not only the catalytic converter 53, but also that portion, mentioned above, of the exhaust manifold 43 which is close to the exhaust guiding portion 46.

Furthermore, as shown in FIGS. 4 and 6, the cylinder periphery water jacket 67 and the exhaust passage periphery water jacket 68 are formed in each of the left bank portion 30A and the right bank portion 30B of the cylinder block 30, and in these water jackets, only the catalyst periphery water jacket 74 of the exhaust passage periphery water jacket 68 is formed and the cylinder periphery water jacket 67 is not formed in a region outside the cylinders 33 in the cylinder block 30 in the width direction of the outboard motor, i.e., in a portion "M" corresponding to the largest diameter portion of the catalytic converter 53 along a radial direction of the cylinders 33.

Consequently, in each of the left bank portion 30A and the right bank portion 30B of the cylinder block 30, the catalyst storage chamber 44 is formed close to the cylinders 33.

Furthermore, as shown in FIG. 3, in each of the left bank portion 30A and the right bank portion 30B of the cylinder block 30, an oxygen sensor 83 adapted to measure oxygen concentration in the exhaust gas is installed at that position, mentioned above, of the exhaust manifold 43 in each of the left exhaust passage 41 and the right exhaust passage 42 which faces a neighborhood of the connecting portion 45.

The oxygen sensor 83 is intended to measure the oxygen concentration in the exhaust gas to detect whether the engine 11 achieves a theoretical air fuel ratio needed for the catalytic converter 53 to efficiently oxidize or reduce nitrogen oxides, hydrocarbons, and carbon monoxide. However, the oxygen sensor 83 is made of ceramics, and thus could be broken if the oxygen sensor 83 gets wet repeatedly at a time of being activated under high temperature conditions.

According to the structure and arrangement of the embodiment of the present invention described above, the following advantageous features (1) to (7) can be achieved.

(1) As shown in FIG. 4, since the cooling water taken in through the intake 61 and led to the water passage 62 flows through the combustion chamber periphery water jacket 65, the exhaust port periphery water jackets 66, the cylinder periphery water jacket 67, and the exhaust passage periphery water jacket 68 in sequence, the cooling water heated in the combustion chamber periphery water jacket 65 and the exhaust port periphery water jackets 67 in sequence flows through the exhaust passage periphery water jacket 68. Because of this reason, as shown in FIG. 3, the exhaust gas flowing through the exhaust manifold 43 in each of the left exhaust passage 41 and the right exhaust passage 42 is not cooled excessively by the cooling water, and as a result, it becomes possible to prevent condensation of the steam contained in the exhaust gas in the exhaust manifold 43, and this fact in turn makes it possible to prevent the oxygen sensor 83 installed in the exhaust manifold 43 from getting wet and to thereby improve the durability of the oxygen sensor 83.

(2) As shown in FIG. 4, in each of the left bank portion 30A and the right bank portion 30B of the cylinder block 30, the cylinder periphery water jacket 67 and the exhaust passage periphery water jacket 68 (the second exhaust manifold periphery water jacket 73B, the third exhaust manifold periphery water jacket 73C, and the catalyst periphery water jacket 74) are connected in parallel and constitute a separate circuit. Consequently, as shown in FIG. 7, even in a case when the required temperature characteristics are different between a periphery of the cylinders 33 and peripheries of the left exhaust passage 41 and the right exhaust passage 42 (peripheries of the exhaust manifolds 43 in the left exhaust passage 41 and the right exhaust passage 42 as well as the catalyst 53), if the cooling water flow rate is adjusted by changing flow channel diameters of, for example, the cylinder periphery water jacket 67 and the exhaust passage periphery water jacket 68 according to the required temperature characteristics, the temperatures around the cylinders 33 as well as around the left exhaust passage 41 and the right exhaust passage 42 can be managed optimally.

(3) As shown in FIGS. 4 and 5, in the combustion chamber periphery water jacket 65 formed in the cylinder head 31, when the cooling water flows in from the side of the lowermost cylinder unit 40, ascends, and flows to the side of the uppermost cylinder unit 40, the temperature of the portion of the combustion chamber periphery water jacket 65 which corresponds to the cylinder head 31 located on the side of the lowermost cylinder unit 40 into which the cooling water flows first, the periphery of the exhaust port 36 becomes lower than the temperature of the other cylinder assemblies 40 because the periphery of the combustion chamber 34 is cooled by the cooling water having low temperature. At this time, in the exhaust port periphery water jacket 66 formed in the cylinder head 31, the cooling water from the combustion chamber periphery water jacket 65 on the side of the uppermost cylinder assembly 40 flows into the side of the uppermost cylinder assembly 40 and flows downward to the side of the lowermost cylinder assembly 40, making it possible to prevent the temperature form falling around the exhaust port 36 on the side of the lowermost cylinder assembly 40 in the cylinder head 31, and as a result, the cylinder head 31 can be cooled uniformly.

(4) As shown in FIG. 3, a portion of the exhaust manifold 43 in each of the left exhaust passage 41 and right exhaust passage 42, i.e., a portion of the exhaust manifold 43 which is close to the exhaust guiding portion 46, is positioned adjacent to the catalyst periphery water jacket 74 of the exhaust passage periphery water jacket 68. Accordingly, the cooling water flowing through the catalyst periphery water jacket 74 cools not only the catalytic converter 53, but also the portion, mentioned above, of the exhaust manifold 43 which is close to the exhaust guiding portion 46, thereby eliminating the need for a water jacket used to cool that portion of the exhaust manifold 43 which is close to the exhaust guiding portion 46, and therefore, an opening diameter of the catalytic converter 53 can be expanded, thereby decreasing pressure loss of the exhaust gas, and improving the power of the engine 11.

Furthermore, since the exhaust gas flowing along the exhaust guiding portion 46 in the exhaust manifold 43 is cooled by the cooling water in the catalyst periphery water jacket 74 warmed by the catalytic converter 53, the temperature of the exhaust gas flowing through the exhaust manifold 43 can be suppressed more securely from excessively falling down, which makes it possible to prevent the oxygen sensor 83 installed in the exhaust manifold 43 from getting wet and thus, further improving the durability of the oxygen sensor 83.

(5) As shown in FIGS. 3 and 6, the catalyst periphery water jacket 74 of the exhaust passage periphery water jacket 68 is formed by the gap 59 between the inner wall surface of the catalyst storage space 44 in each of the left bank portion 30A and the right bank portion 30B of the cylinder block 30 and the outer lateral surface of the catalyst tube 55 of the catalytic converter 53 and is provided around the catalytic converter 53. Accordingly, since the catalyst tube 55 of the catalytic converter 53 comes into direct contact with the cooling water in the catalyst periphery water jacket 74, it becomes possible to improve the cooling efficiency of the catalytic converter 53, and the volume of the cooling water flowing through the catalyst periphery water jacket 74 can be hence reduced. It also becomes possible to reduce a cross sectional area of a flow channel of the catalyst periphery water jacket 74 to thereby downsize the cylinder block 30 in which the catalyst periphery water jacket 74 is formed.

(6) The catalytic converter 53 is made up of the catalyst carrier 54 contained in the catalyst tube 55. For example, as described in Patent Document 2 (Japanese Patent Laid-Open No. 2010-242744), when a catalyst storage portion is formed integrally with a housing which makes up an exhaust passage, the catalyst storage portion has a thick-walled structure. In contrast, according to the present embodiment, since the catalyst carrier 54 is contained in the catalyst tube 55 of the thin-walled structure, the catalytic converter 53 can be downsized accordingly. Thus, if the catalytic converter 53 is not downsized, the opening diameter of the catalyst carrier 54 can be increased and the pressure loss of the exhaust gas flowing through the catalyst carrier 54 decreases. As a result, the power of the engine 11 can be improved.

(7) As shown in FIG. 6, in a region outside the cylinders 33 in the cylinder block 30 in the width direction of the outboard motor, i.e., in the portion "M" corresponding to the largest diameter portion of the catalytic converter 53 along the radial direction of the cylinders 33, only the catalyst periphery water jacket 74 of the exhaust passage periphery water jacket 68 is formed and the cylinder periphery water jacket 67 is not formed. As a result, the catalyst storage chamber 44 can be formed close to the cylinders 33 in each of the left bank portion 30A and the right bank portion 30B of the cylinder block 30, thereby reducing the size of the outboard motor 10 in the width direction. Further, when a plurality of the outboard motors 10 are installed side by side on the transom 20A of the hull 20, the plural outboard motors 10 can be clustered in a center of the hull 20 in the width direction by reducing installation intervals of the plural outboard motors 10.

It is to be noted that the present invention is not limited to the embodiments described above as preferred examples, and many other changes, modifications, and alternations may be made without departing from the sprits of the present invention and scope of the appended claims.

For example, although in the embodiment described above, the engine 11 mounted on the outboard motor 10 is a V-type multi-cylinder four-stroke engine, an in-line multi-cylinder four-stroke type or single-cylinder four-stroke type may be adopted as the engine 11.

What is claimed is:

1. An outboard motor including a cooling water passage structure, the outboard motor comprising:

a four-stroke engine;

an intake unit for the four-stroke engine and having an intake port configured to take in water from underwater; and a water passage configured to supply the water taken in through the intake unit to the four-stroke engine as cooling water, wherein the four-stroke engine includes a cylinder block in which a cylinder is formed by extending in a horizontal direction, a cylinder head fixed to the cylinder block so as to cover the cylinder, wherein the cylinder head is configured to form a combustion chamber together with the cylinder, and wherein the cylinder head is provided with an exhaust port configured to discharge exhaust gas in communication with the combustion chamber, and an exhaust passage connected to the exhaust port so as to lead the exhaust gas to outside the engine, wherein a combustion chamber periphery water jacket through which the cooling water flows to surround and cool the combustion chamber, and an exhaust port periphery water jacket, through which the cooling water flows to surround and cool the exhaust port, are both formed in the cylinder head, wherein a cylinder periphery water jacket, through which the cooling water flows to surround and cool the cylinder, is formed in the cylinder block, wherein an exhaust passage periphery water jacket through which the cooling water flows around the exhaust passage is formed around the exhaust passage, wherein the cylinder periphery water jacket and the exhaust passage periphery water jacket are connected in parallel, and wherein the combustion chamber periphery water jacket, the exhaust port periphery water jacket, the cylinder periphery water jacket and the exhaust passage periphery jacket are connected to one another such that the cooling water from the water passage flows through the combustion chamber periphery water jacket, the exhaust port periphery water jacket, and the parallel configuration of the cylinder periphery water jacket, and the exhaust passage periphery water jacket in that order.

2. The outboard motor according to claim 1, further comprising a plurality of cylinder assemblies each including a cylinder as recited in claim 1, the combustion chamber, and the exhaust port, wherein the cylinder assemblies are arranged side by side in a vertical direction, and the exhaust passage is connected to the respective exhaust ports of the plurality of cylinder assemblies.

3. The outboard motor according to claim 1, wherein the cylinder periphery water jacket and the exhaust passage periphery water jacket are configured into a separate circuit.

4. The outboard motor according to claim 2, wherein, in the combustion chamber periphery water jacket, the cooling water flows into a side of a lowermost cylinder assembly of the plurality of cylinder assemblies and flows upward to a side of an uppermost cylinder assembly of the plurality of cylinder assemblies, and wherein, in the exhaust port periphery water jacket, the cooling water from the combustion chamber periphery water jacket on the side of the uppermost cylinder assembly flows into the side of the uppermost cylinder assembly and flows downward to the side of the lowermost cylinder assembly.

5. The outboard motor according to claim 2, wherein for each one of the plurality of cylinder assemblies, the exhaust passage is formed integrally with the cylinder block and equipped with an exhaust manifold to gather the exhaust gas discharged from the respective exhaust ports of the plural cylinder assemblies, wherein each of the plurality of cylinder assemblies further comprises a catalyst storage chamber provided in communication with the exhaust manifolds to store catalyst, and wherein in the exhaust passage periphery water jacket, an exhaust manifold periphery water jacket through which the cooling water flows to surround and cool the exhaust manifold and a catalyst periphery water jacket through which the cooling water flows to surround and cool catalyst are provided so as to communicate with each other, and the exhaust manifold has a portion located adjacent to the catalyst periphery water jacket.

6. The outboard motor according to claim 5, wherein the catalyst is composed of a catalyst carrier having an exhaust purification function contained in a catalyst tube, and wherein the catalyst periphery water jacket is formed by a gap provided between an inner wall surface of the catalyst storage chamber in the cylinder block and an outer side surface of the catalyst tube.

7. The outboard motor according to claim 5, wherein in the cylinder block, the catalyst periphery water jacket is formed around the catalyst, and the cylinder periphery water jacket is formed around the respective cylinder, wherein only the catalyst periphery water jacket is formed in a region outside the respective cylinder in the cylinder block in a width direction of the outboard motor, at a portion corresponding to a largest diameter portion of the catalyst along a radial direction of the respective cylinder.

8. The outboard motor according to claim 3, wherein the exhaust passage periphery water jacket includes multiple exhaust manifold periphery water jacket and a catalyst periphery water jacket, and those components of the exhaust passage periphery water jacket are connected in parallel with the cylinder periphery water jacket.

9. The outboard motor according to claim 2, wherein required temperature characteristics are different between a periphery of the plurality of cylinders and peripheries of the exhaust passage.

10. The outboard motor according to claim 9, wherein a cooling water flow rate is adjustable by changing flow channel diameters of the cylinder periphery water jacket and the exhaust passage periphery water jacket.

* * * * *